United States Patent [19]

Brice

[11] 4,353,575

[45] Oct. 12, 1982

[54] SKI BINDING

[76] Inventor: Ralph E. Brice, 3012 124th Ave. Northeast, Bellevue, Wash. 98005

[21] Appl. No.: 195,392

[22] Filed: Oct. 9, 1980

[51] Int. Cl.[3] ..... A63C 9/00

[52] U.S. Cl. ..... 280/614; 280/607; 280/617

[58] Field of Search ..... 280/614, 615, 617, 618, 280/607

[56] References Cited

U.S. PATENT DOCUMENTS

| | | | |
|---|---|---|---|
| 3,685,846 | 8/1972 | Schmid | 280/607 |
| 3,964,756 | 6/1976 | Mory | 280/614 |
| 4,141,570 | 2/1969 | Sudmeier | 280/607 |

FOREIGN PATENT DOCUMENTS

| | | | |
|---|---|---|---|
| 122386 | 7/1901 | Fed. Rep. of Germany | 280/12 F |

*Primary Examiner*—Joseph F. Peters, Jr.
*Assistant Examiner*—Milton L. Smith
*Attorney, Agent, or Firm*—Seed, Berry, Vernon & Baynham

[57] ABSTRACT

A bridge for alpine skiing is positioned to span over the toepiece of a conventional downhill, releasable ski binding. In one embodiment, the bridge is an elongated platform pivotable forwardly of the toepiece of the downhill binding and supported between the toepiece and the heelpiece of the downhill binding by an adjustable post. In another embodiment, a platform is stationarily mounted ahead of the toepiece of the downhill binding, with a separate heel support secured to the ski between the downhill toepiece and heelpiece.

5 Claims, 3 Drawing Figures

SKI BINDING

BACKGROUND OF THE INVENTION

1. Field of the Invention

This invention pertains to ski bindings and particularly to the type of ski binding which allows free movement of the foot relative to the ski for moving cross-country or up hills, and which is known as "alpine" skiing.

2. Description of the Prior Art

Conventional releasable ski bindings having a pivotal toepiece are well known. These downhill bindings provide very rigid, but highly controllable, releasable attachment of a rigid boot to the ski for high-speed downhill skiing. The downhill skis associated with these bindings are of the type that are provided with steel edges and, when compared with cross-country skis, are relatively short.

A second type of well-known ski is the long, thin, lightweight wooden ski which generally comes without steel edges and which is provided with a binding that allows free movement of the heel of the boot relative to the ski. Generally, a soft, flexible boot is worn with this type of ski to enable the skier to walk with the ski. Ease of walking is an important criteria for cross-country skis to avoid undue fatigue.

A third type of ski is known as an "alpine ski" and uses an "alpine binding." Examples of alpine bindings are shown in U.S. Pat. Nos. 4,002,354 and 3,908,971. This type of ski is quite similar to a conventional downhill ski and has a binding which can lock the heel into a releasable but tight position for downhill skiing, but allows removal of the heelpiece from the boot for free flexing of the boot when going cross-country or uphill. When it is time to ski back down the hill, the heelpiece is again attached to the boot to attempt to provide a normal downhill, releasable ski binding arrangement. In some instances, an entire plate is attached to the toepiece, and this plate can be released from the heel of the binding so that the user, if walking uphill, can flex his foot and lift the heel of the binding off the ski. Although alpine bindings do provide both a toepiece and a heelpiece, the releasing quality is not as safe as that of a conventional downhill ski binding due to the necessity of providing for a longterm release or separation of the heelpiece for cross-country and uphill walking.

Since alpine skiing is not done with the frequency of conventional packed-slope, downhill skiing, the skier seldom wants to sacrifice the advantageous safety release of good downhill bindings; and thus, to accommodate the occasional alpine skiing, must buy a complete second set of skis fitted with alpine bindings.

One attempt to reduce the cost of alpine skiing and improve safety is illustrated in the binding shown in U.S. Pat. No. 3,964,756. The binding shown in this patent employs a plate which bridges over the heelpiece of a conventional downhill binding. The front of the plate is supported by a pivoting axle which is carried on a vertical web. This web is then attached to a mounting plate which is releasably attached to the ski between the toepiece and heelpiece of the conventional downhill binding by a pair of clamps. There are several difficulties in the use of the binding shown in this patent. First of all, the plate is pivoted between the toepiece and the heelpiece of the conventional downhill binding. This causes the center of gravity of the skier to be far rearward on the ski, causing difficulty in walking the skis.

Secondly, the placement of the clamps for attaching the forward part of the pivotable part of the plate is located between the toepiece and heelpiece, which interferes with the necessary low-friction engagement between the downhill ski boot and ski when fastened tightly in the downhill binding.

It is thus an object of this invention to provide an alpine binding which positions the pivot point of the alpine binding forward of the ski's center of gravity when attached to a downhill ski.

It is another object of this invention to provide a alpine binding which can be removed from a downhill ski in a manner which restores the downhill binding to its same, safely operable condition for downhill skiing.

It is a still further object of this invention to provide an improved alpine binding which enables use of a conventional downhill ski and binding for comfortable walking cross-country or up hills.

Basically, these objects are obtained by providing a bridge over the forward toepiece of a conventional downhill binding and which allows free flexure of the foot for ease of walking in a cross-country or uphill skiing mode. The bridge is removable without interfering with the location or condition of the downhill binding so that once the skier reaches the top of a desired hill, the skier can remove the alpine bridge and return to use of the safe, releasable downhill binding. In the preferred embodiment of the invention, the bridge is an elongated platform pivotally mounted to the ski forward of the downhill binding toepiece and is supported between the downhill binding toepiece and heelpiece by a post which freely rests on the downhill ski. Conventional alpine toe and heelpieces are then attached to the platform for mounting either the conventional rigid downhill boot or, if desired, a soft, flexible boot. In another embodiment, the bridge is two separate pieces, including a post and short platform forward of the toepiece. The post is detachably or stationarily mounted, but is rigid in construction and supports only the toe and forward part of the ball of the foot. A separate, detachable, rigid heel support is then positioned between the toepiece and the heelpiece of the downhill binding such that the toe of the boot is then secured to the forward platform but the heel of the boot is allowed to pivot upwardly, away from the stationary rearward platform. As is readily apparent, the skier now can operate the conventional downhill skis in an alpine skiing technique for climbing hills or going cross-country. Yet when an ascent is made, downhill skiing can be resumed by easily removing the alpine bridging attachments.

BRIEF DESCRIPTION THE FIGURES OF THE DRAWING

DETAILED DESCRIPTION OF THE PREFERRED EMBODIMENTS

Figure 1:
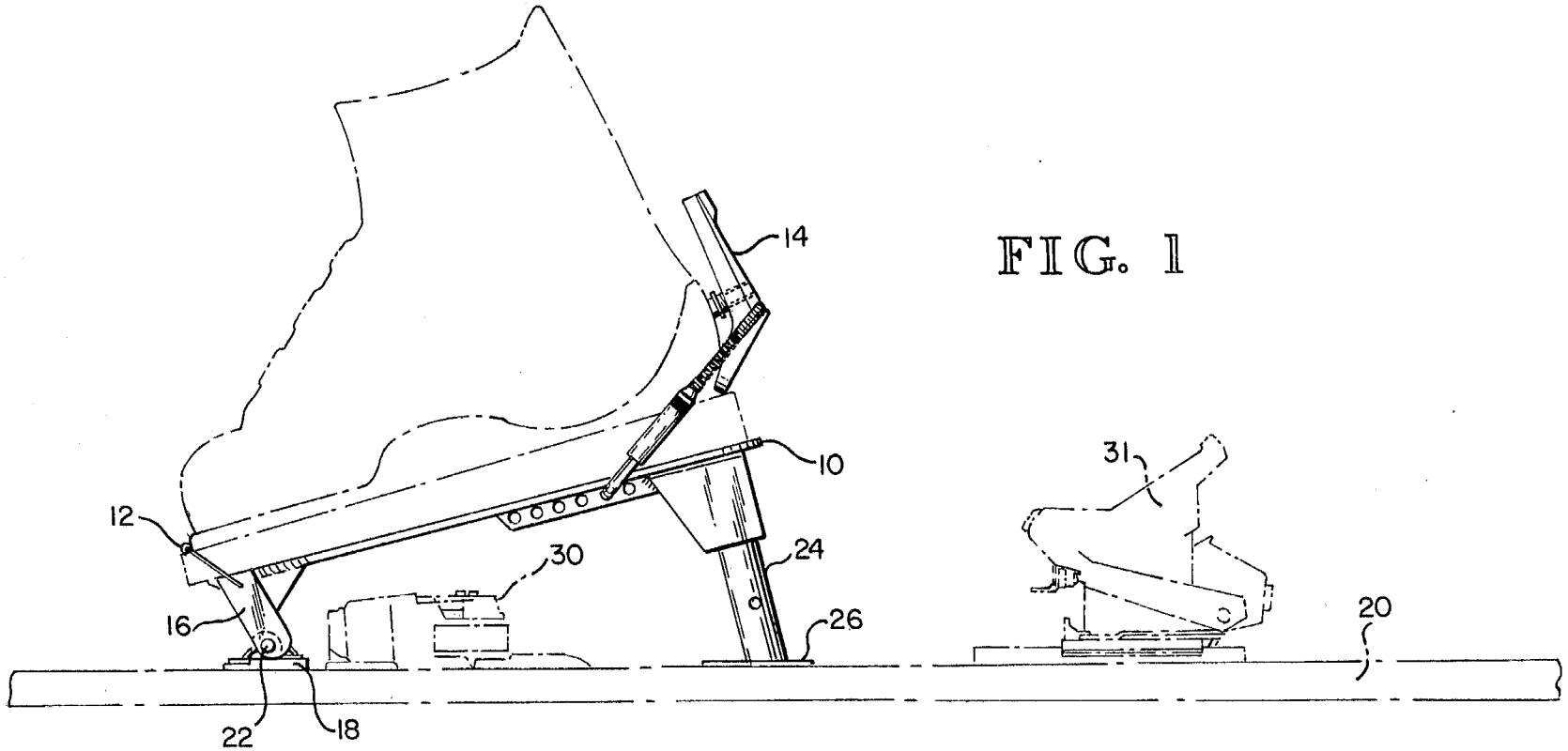
FIG. 1 is a side elevation of the alpine binding in position on a downhill ski.
Figure 2:
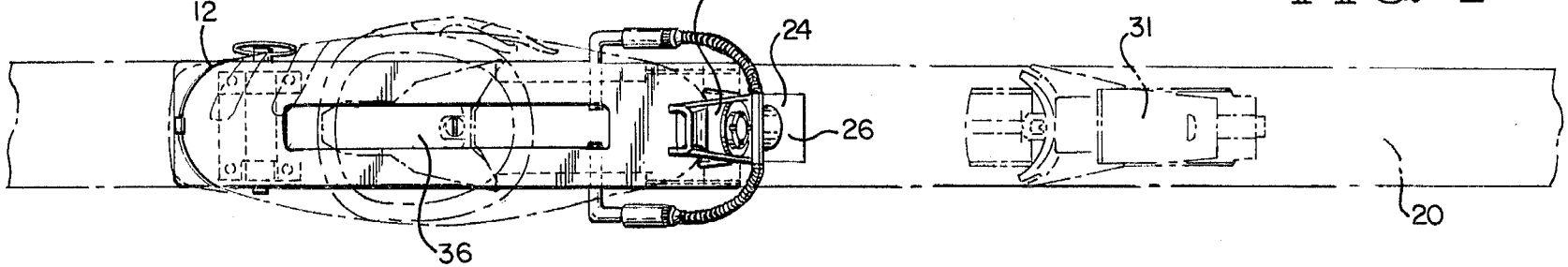
FIG. 2 is a plan view of the alpine binding of FIG. 1.

As best shown in FIGS. 1 and 2, in the preferred embodiment, a platform 10 is provided with a hoop-type toepiece 12 for holding the forward end of a ski boot. A conventional heelpiece 14 attached at the rear end of the platform 10 is adjustably positioned to compensate for different boot sizes. The platform is rigidly attached to a web 16 which is pivotally mounted in a hinge plate 18 that is secured to the downhill ski 20 in a permanent manner. A pin 22 detachably, pivotally connects the post or web 16 to the hinge 18.

The rear end of the platform 10 is supported by a rigid post 24 which is preferably vertically extendible so that the bridge plate can be adjusted to be parallel to or at an angle to the ski 20. As is best shown in FIG. 1, the post 24 is merely resting on a low-friction pad 26 which can be part of the low-friction pad material for operation of the downhill boot in the conventional downhill binding toepiece 30 and heelpiece 31. Thus the pad 26 does not interfere with operation of the sliding movement of the boot on the downhill ski, which is essential to safe and correct operation of the normal downhill release bindings.

As is also well known, the normal placement of the toepiece 30 of the downhill binding is approximately at the center of gravity of the ski. With the location of pivot 22 on this platform, the pivot point is now well forward of the center of gravity of the ski. This advantageously causes the forward tip of the ski to lift during the normal walking stride when the skier is on the platform and greatly reduces the drag and fatigue associated with cross-country or alpine skiing.

Figure 3:
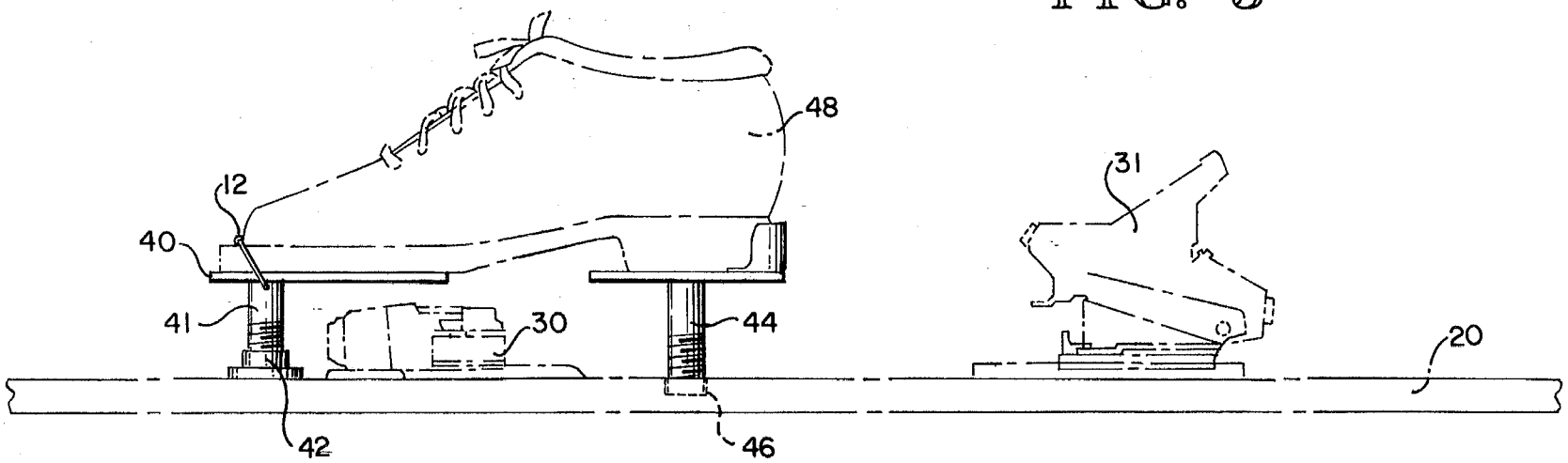
FIG. 3 is a side elevation of a modified form of alpine binding shown on a downhill ski.

FIG. 3 shows another embodiment, in which a short toe platform 40 is rigidly secured to a post 41 that is releasably or permanently connected to the ski forward of the toepiece 30. In the embodiment shown, the post is preferably threaded into a bracket 42, which is permanently attached to the ski. In this embodiment, a second, separate heel platform 44 is removably attached in a bore 46 in the ski between the toepiece 30 and the heelpiece 31. A cable loop or toepiece 12 holds the toe of the soft boot 48 tightly to the toe platform 40, but allows the soft boot to flex so that it can have a pivotal movement relative to the ski. The platform 44 in this embodiment then merely supports the heel of the boot when the boot is resting on the platform. Again, in this embodiment, the platform 44 is removable from the bore 46 so that the area between the toepiece 30 and the heelpiece 31 is clear for safe operation when the ski is used for downhill skiing. In this embodiment, the toepiece can either be left on the ski permanently or, for further safety, can be removed.

While the preferred embodiments of the invention have been illustrated and described, it should be understood that variations will be apparent to one skilled in the art without departing from the principles herein. Accordingly, the invention is not to be limited to the specific embodiments illustrated in the drawing.

I claim:

1. A detachable alpine ski binding suitable for use on a downhill ski of the type having a downhill binding with releasable toe and heelpieces, comprising:

bridge means having a forward end detachably mounted on the ski forward of the downhill binding toepiece for supporting the forward portion of a ski boot above the downhill binding toepiece, means engageable with the ski for supporting the rearward portion of the ski boot between the downhill binding toe and heelpieces while allowing the rearward portion of the ski boot to move freely upward, and means for holding a boot on the platform.

2. The binding of claim 1, said bridge means including an elongated platform completely spanning the downhill binding toepiece, said bridge means including a hinge member secured to the ski forward of the downhill binding toepiece, said means for supporting the rearward portion of the ski boot including a post coupled to the platform, and said platform being pivotally and releasably secured to the hinge member for allowing the platform to pivot about a point forward of the binding toepiece.

3. The binding of claim 2, said means for supporting the rearward portion of the ski boot including a post vertically adjustably attached to the rear end of the elongated platform and resting freely on the ski.

4. The binding of claim 1 wherein said means for supporting the rearward portion of the ski boot is vertically extendible to elevate the rearward portion of the ski boot.

5. The binding of claim 1, said bridge means including a forward, short, rigid platform for supporting the toe of the boot, said means for supporting the boot rearward portion including a rearward second platform separate from said forward platform, and means for detachably connecting said second platform to said ski.

* * * * *